US010930238B1

(12) United States Patent
Li

(10) Patent No.: US 10,930,238 B1
(45) Date of Patent: Feb. 23, 2021

(54) GOA CIRCUIT AND LCD DEVICE INCLUDING THE SAME

(71) Applicant: SHENZHEN CHINA STAR OPTOELECTRONICS SEMICONDUCTOR DISPLAY TECHNOLOGY CO., LTD., Guangdong (CN)

(72) Inventor: Wenying Li, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 318 days.

(21) Appl. No.: 16/314,463

(22) PCT Filed: Sep. 14, 2018

(86) PCT No.: PCT/CN2018/105779
§ 371 (c)(1),
(2) Date: Dec. 31, 2018

(87) PCT Pub. No.: WO2020/019442
PCT Pub. Date: Jan. 30, 2020

(30) Foreign Application Priority Data

Jul. 27, 2018 (CN) ..... 201810848278.2

(51) Int. Cl.
*G09G 3/36* (2006.01)

(52) U.S. Cl.
CPC ..... *G09G 3/3677* (2013.01)

(58) Field of Classification Search
None
See application file for complete search history.

(56) References Cited

U.S. PATENT DOCUMENTS

2016/0275887 A1* 9/2016 Xiao ..... G09G 3/3648
2016/0284294 A1* 9/2016 Dai ..... H04N 13/359
(Continued)

FOREIGN PATENT DOCUMENTS

CN 1825420 A 8/2006
CN 103500550 A 1/2014
(Continued)

OTHER PUBLICATIONS

Chinese Office Action issued in corresponding Chinese Patent Application No. 201810848278.2 dated Apr. 28, 2019.

*Primary Examiner* — Krishna P Neupane
(74) *Attorney, Agent, or Firm* — Leong C. Lei

(57) ABSTRACT

The GOA circuit includes multiple cascaded GOA units. An (n)th GOA unit includes pull-up control circuit, pull-up circuit, pull-down circuit, first pull-down holding circuit, and second pull down holding circuit. The pull-up control circuit receives an activation signal CT, and outputs a pull-up control signal Q(n). The pull-up circuit receives Q(n) and a first clock signal CK, and outputs an (n)th cascade signal ST(n) and an (n)th scan signal G(n). The pull-down circuit receives an (n+4)th cascade signal ST(n+4), a first DC low-voltage signal VSSG1, and a second DC low-voltage signal VSSQ2, and keeps Q(n) and G(n) at a turn-off state. The first pull-down holding circuit receives CK, ST(n), VSSG1, and VSSQ2, and keeps Q(n) and G(n) at the turn-off state. The second pull down holding circuit receives a second clock signal XCK, an (n−4)th cascade signal ST(n−4), and VSSG1, and keeps Q(n) and G(n) at the turn-off state.

18 Claims, 3 Drawing Sheets

(56) References Cited

U.S. PATENT DOCUMENTS

| | | | | |
|---|---|---|---|---|
| 2017/0229084 | A1* | 8/2017 | Wang | G09G 3/3696 |
| 2018/0211626 | A1* | 7/2018 | Shi | G09G 3/3677 |

FOREIGN PATENT DOCUMENTS

| | | | |
|---|---|---|---|
| CN | 104332144 | A | 2/2015 |
| CN | 105280153 | A | 1/2016 |
| CN | 106652936 | A | 5/2017 |
| CN | 107123405 | A | 9/2017 |
| CN | 107909971 | A | 4/2018 |
| KR | 20150078587 | A | 7/2015 |

* cited by examiner

GOA CIRCUIT AND LCD DEVICE INCLUDING THE SAME

CROSS-REFERENCE TO RELATED APPLICATIONS

This application is a National Phase of International Application No. PCT/CN2018/105779, filed Sep. 14, 2018, and claims the priority of Chinese Patent Application No. 201810848278.2, filed on Jul. 27, 2018, the disclosure of which is incorporated herein by reference in its entirety.

FIELD OF THE INVENTION

The present invention is generally related to the field of display technology, and more particularly to a GOA (Gate driver On Array) circuit and a LCD (liquid crystal display) device including the GOA circuit.

BACKGROUND OF THE INVENTION

LCD devices have replaced CRT (cathode ray tube) devices as the mainstream display for various electronic products, due to their light weight, small thickness, low power consumption, and little radiation. Currently, external IC (integrated circuit) is used to drive scan lines in a LCD panel by charging and discharging the scan lines stage by stage. The GOA technique is to form scan line driving circuit on the TFT (thin film transistor) array substrate surrounding the active area of the LCD panel. The GOA technique may reduce the bonding process to the external IC, increase productivity, lower production cost, and make LCD panel more appropriate for thin or zero bezel design.

An existing GOA circuit includes a pull-up control circuit, a pull-up circuit, a pull-down circuit, a first pull-down holding circuit, and a second pull down holding circuit. The pull-up circuit outputs scan signal from clock signal. The pull-up control circuit outputs pull-up control signal to control when to turn on the pull-up circuit. The pull-down circuit pulls the pull-up control signal and the scan signal down. The first pull-down holding circuit and the second pull down holding circuit, through respectively receiving a first low-frequency signal and a second low-frequency signal, alternately keep the pull-up control signal and the scan signal at a low level. However, the existing GOA circuit requires a number of signal lines and related circuit modules, thereby occupying more space and contradicting the design for thin bezel. Therefore, how to save the space occupied by the GOA circuit to achieve thin or zero bezel design without sacrificing the overall reliability of the GOA circuit becomes a major issue.

SUMMARY OF THE INVENTION

The present invention teaches a GOA circuit and a LCD device including the GOA circuit. By having a first clock signal and a second clock signal in the GOA circuit that respectively control a first pull-down holding circuit and a second pull down holding circuit, fewer signal lines are required by the pull-down holding circuits while guaranteeing the overall reliability of the GOA circuit.

The present invention teaches a GOA circuit, comprising a plurality of cascaded GOA units. An (n)th GOA unit charges an (n)th scan line of the active area of a panel, and comprises a pull-up control circuit, a pull-up circuit, a pull-down circuit, a first pull-down holding circuit, and a second pull down holding circuit (n is a positive integer).

The pull-up control circuit receives an activation signal CT, and outputs a pull-up control signal Q(n) according to the activation signal CT. The pull-up circuit is electrically connected to the pull-up control circuit, receives the pull-up control signal Q(n) and a first clock signal CK, and outputs an (n)th cascade signal ST(n) and an (n)th scan signal G(n) according to the pull-up control signal Q(n) and the first clock signal CK. The pull-down circuit is electrically connected to the pull-up control circuit and the pull-up circuit, receives an (n+4)th cascade signal ST(n+4) from an (n+4)th GOA unit, a first DC low-voltage signal VSSG1, and a second DC low-voltage signal VSSQ2, and pulls down the pull-up control signal Q(n) and the (n)th scan signal G(n) according to the (n+4)th cascade signal ST(n+4), the first DC low-voltage signal VSSG1, and the second DC low-voltage signal VSSQ2, so that the pull-up control signal Q(n) and the (n)th scan signal G(n) are at a turn-off state, The first pull-down holding circuit is electrically connected to the pull-up control circuit, the pull-up circuit, and the pull-down circuit; the first pull-down holding circuit receives the first clock signal CK, the (n)th cascade signal ST(n), the first DC low-voltage signal VSSG1, and the second DC low-voltage signal VSSQ2, and keeps the pull-up control signal Q(n) and the (n)th scan signal G(n) at the turn-off state according to the first clock signal CK, the first DC low-voltage signal VSSG1, and the second DC low-voltage signal VSSQ2. The second pull down holding circuit is electrically connected to the pull-up control circuit, the pull-up circuit, the pull-down circuit, and the first pull-down holding circuit. The second pull down holding circuit receives a second clock signal XCK, the (n−4)th cascade signal ST(n−4), and the first DC low-voltage signal VSSG1, and keeps the pull-up control signal Q(n) and the (n)th scan signal G(n) at the turn-off state according to the second clock signal XCK and the first DC low-voltage signal VSSG1.

When n is greater than or equal to 1, and n is less than or equal to 4, the activation signal CT is an initialization signal STV; the pull-up control circuit outputs the pull-up control signal Q(n) according to the initialization signal STV; when n is greater than 4, the activation signal CT comprises an (n−4)th cascade signal ST(n−4) and an (n−4)th scan signal G(n−4) output from an (n−4)th GOA unit; the pull-up control circuit outputs the pull-up control signal Q(n) according to the (n−4)th cascade signal ST(n−4) and the (n−4)th scan signal G(n−4).

The first pull-down holding circuit and the second pull down holding circuit alternately keep the pull-up control signal Q(n) and the (n)th scan signal G(n) at the turn-off state.

The first clock signal CK and the second clock signal XCK are inverted to each other.

The (n)th GOA unit further comprises a reset circuit, a leakage prevention circuit, and a stabilizer circuit. The reset circuit is electrically connected to the pull-up control circuit and the pull-up circuit, receives the initialization signal STV and the first DC low-voltage signal VSSG1, and resets the pull-up control signal Q(n) according to the initialization signal STV and the first DC low-voltage signal VSSG1. The leakage prevention circuit is electrically connected to the first pull-down holding circuit, receives the (n−4)th cascade signal ST(n−4) and the second DC low-voltage signal VSSQ2, and prevents the pull-up control signal Q(n) from leaking through the first pull-down holding circuit according to the (n−4)th cascade signal ST(n−4) and the second DC low-voltage signal VSSQ2. The stabilizer circuit is electrically connected to the pull-up circuit, the first pull-down holding circuit, and the leakage prevention circuit; and the stabilizer circuit receives the (n+4)th cascade signal ST(n+4) and the second DC low-voltage signal VSSQ2, and keeps the (n)th cascade signal ST(n) at the second DC low-voltage signal VSSQ2 according to the (n+4)th cascade signal ST(n+4) and the second DC low-voltage signal VSSQ2.

The pull-up control circuit comprises a first TFT (T11); when n is greater than or equal to 1, and n is less than or equal to 4, the first TFT (T11) receives the initialization signal STV from a control terminal and a first terminal, has a second terminal connected to a pull-up control signal junction Q, and outputs the pull-up control signal Q(n) according to the initialization signal STV; when n is greater than 4, the first TFT (T11) receives the (n−4)th cascade signal ST(n−4) from a control terminal, receives the (n−4)th scan signal G(n−4) from a first terminal, has a second terminal connected to the pull-up control signal junction Q, and outputs the pull-up control signal Q(n) according to the (n−4)th cascade signal ST(n−4) and the (n−4)th scan signal G(n−4). The pull-up circuit comprises a second TFT (T22) and a third TFT (T21); the second TFT (T22) has a control terminal electrically connected to the pull-up control signal junction Q for receiving the pull-up control signal Q(n), receives the first clock signal CK from a first terminal, has a second terminal electrically connected to a first signal junction 5, and outputs the (n)th cascade signal ST(n) according to the pull-up control signal Q(n) and the first clock signal CK; the third TFT (T21) has a control terminal electrically connected to the pull-up control signal junction Q for receiving the pull-up control signal Q(n), receives the first clock signal CK from a first terminal, has a second terminal electrically connected to a scan line G, and outputs the (n)th scan signal G(n) according to the pull-up control signal Q(n) and the first clock signal CK. The pull-down circuit 30 comprises a fourth TFT (T31) and a fifth TFT (T41); the fourth TFT (T31) has a control terminal electrically connected to a control terminal of the fifth TFT (T41) for receiving an (n+4)th cascade signal ST(n+4), has a first terminal electrically connected to the scan line G, receives a first DC low-voltage signal VSSG1 from a second terminal, and pulls down the (n)th scan signal G(n) according to the (n+4)th cascade signal ST(n+4) and the first DC low-voltage signal VSSG1 so that the (n)th scan signal G(n) is at the turn-off state; the fifth TFT (T41) has a first terminal electrically connected to the pull-up control signal junction Q, receives a second DC low-voltage signal VSSQ2 from a second terminal, and pulls down the pull-up control signal Q(n) according to the (n+4)th cascade signal ST(n+4) and the second DC low-voltage signal VSSQ2 so that the pull-up control signal Q(n) is at the turn-off state The reset circuit comprises a sixth TFT (Txo) which receives the initialization signal STV from a control terminal, has a first terminal electrically connected to the pull-up control signal junction Q, and receives the first DC low-voltage signal VSSG1 from a second terminal; the sixth TFT (Txo), after the GOA circuit operates a cycle, resets the pull-up control signal junction Q's level according to the initialization signal STV and the first DC low-voltage signal VSSG1. The first pull-down holding circuit comprises a seventh TFT (T51), an eighth TFT (T52), a ninth TFT (T53), a tenth TFT (T54), an eleventh TFT (T42), and a twelfth TFT (T32); the seventh TFT (T51) receives the first clock signal CK from a control terminal and a first terminal, and has a second terminal electrically connected to a second signal junction N; the eighth TFT (T52) has a control terminal electrically connected to the first signal junction S for receiving the (n)th cascade signal ST(n), has a first terminal electrically connected to the second signal junction N, and receives the second DC low-voltage signal VSSQ2 from a second terminal; the ninth TFT (T53) has a control terminal electrically connected to the second signal junction N, receives the first clock signal CK from a first terminal, and has a second terminal electrically connected to a third signal junction P; the tenth TFT (T54) has a control terminal electrically connected to the first signal junction S for receiving the (n)th cascade signal ST(n), has a first terminal electrically connected to the third signal junction P, and receives the second DC low-voltage signal VSSQ2 from a second terminal; the eleventh TFT (T42) has a control terminal electrically connected to the third signal junction P, has a first terminal electrically connected to the pull-up control signal junction Q and the scan line G, receives the second DC low-voltage signal VSSQ2 from a second terminal, and keeps the pull-up control signal Q(n) and the (n)th scan signal G(n) at the turn-off state according to the first clock signal CK and the second DC low-voltage signal VSSQ2; the twelfth TFT (T32) has a control terminal electrically connected to the third signal junction P, has a first terminal electrically connected to the pull-up control signal junction Q and the scan line G, receives the first DC low-voltage signal VSSG1 from a second terminal, and keeps the pull-up control signal Q(n) and the (n)th scan signal G(n) at the turn-off state according to the first clock signal CK and the first DC low-voltage signal VSSG1. The leakage prevention circuit comprises a thirteenth TFT (T56) and a fourteenth TFT (T55); the thirteenth TFT (T56) receives the (n−4)th cascade signal ST(n−4) from a control terminal, has a first terminal electrically connected to the third signal junction P, and receives the second DC low-voltage signal VSSQ2 from a second terminal; the fourteenth TFT (T55) receives the (n−4)th cascade signal ST(n−4) from a control terminal, has a first terminal electrically connected to the second signal junction N, and receives the second DC low-voltage signal VSSQ2 from a second terminal. The second pull down holding circuit comprises a fifteenth TFT (T43) and a sixteenth TFT (T33); the fifteenth TFT T43 receives the second clock signal XCK from a control terminal, has a first terminal electrically connected to the pull-up control signal junction Q, and receives the (n−4)th cascade signal ST(n−4) from a second terminal, and keeps the pull-up control signal Q(n) at the turn-off state according to the second clock signal XCK and the (n−4)th cascade signal ST(n−4); the sixteenth TFT (T33) receives the second clock signal XCK from a control terminal, has a first terminal electrically connected to the scan line G, receives the first DC low-voltage signal VSSG1 from a second terminal, and keeps the (n)th scan signal G(n) at the turn-off state according to the second clock signal XCK and the first DC low-voltage signal VSSG1. The stabilizer circuit comprises a seventeenth TFT (T72) and an eighteenth TFT (T71); the seventeenth TFT (T72) has a control terminal electrically connected to the third signal junction P has a first terminal electrically connected to the first signal junction S, receives the second DC low-voltage signal VSSQ2 from a second terminal, and stabilizes the (n)th cascade signal ST(n) at the second DC low-voltage signal VSSQ2 according to the first clock signal CK and the second DC low-voltage signal VSSQ2; and the eighteenth TFT (T71) receives the (n+4)th cascade signal ST(n+4) from a control terminal, has a first terminal electrically connected to the first signal junction S, receives the second DC low-voltage signal VSSQ2 from a second terminal, and stabilizes the (n)th cascade signal ST(n) at the second DC low-voltage signal VSSQ2 according to the (n+4)th cascade signal ST(n+4) and the second DC low-voltage signal VSSQ2.

The first DC low-voltage signal VSSG1 is a DC low-voltage signal required by the LCD panel. The second DC low-voltage signal VSSQ2 is less than the first DC low-voltage signal VSSG1.

The pull-up control signal junction Q is electrically connected to the scan line G through a capacitor (Cb); and the capacitor (Cb) is a Boast capacitor.

The present invention also teaches a LCD device including the above described GOA circuit.

As described above, the present invention teaches a GOA circuit and a LCD device including the GOA circuit. By having the first clock signal and the second clock signal in the GOA circuit that respectively control the first pull-down holding circuit and the second pull down holding circuit, fewer signal lines are required by the pull-down holding circuits while guaranteeing the overall reliability of the GOA circuit.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Figure 1:
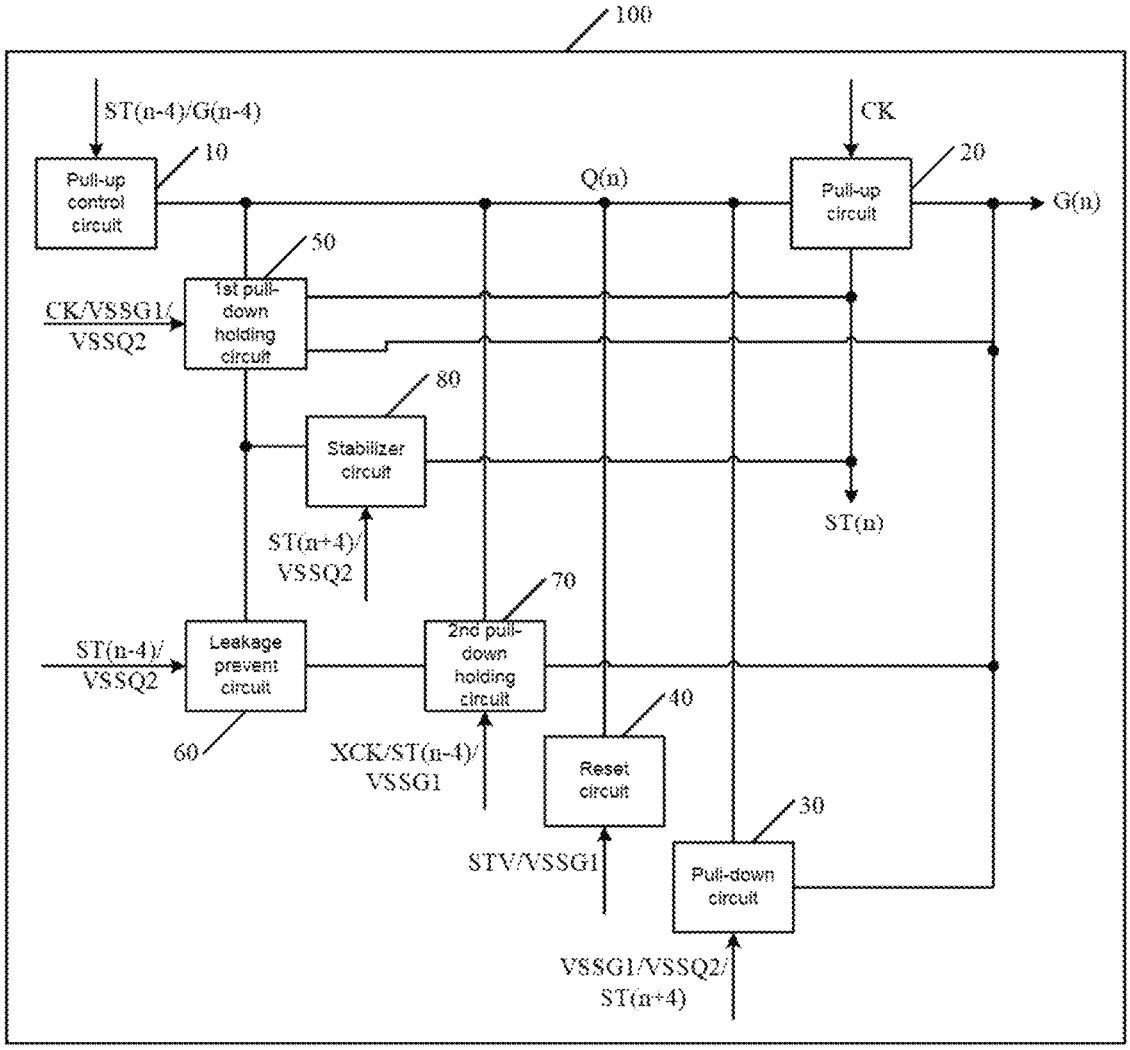
FIG. 1 is a block diagram showing a GOA circuit according to an embodiment of the present invention

The following descriptions for the respective embodiments are specific embodiments capable of being implemented for illustrations of the present invention with referring to appended figures. These embodiments are a portion of all possible embodiments of the present invention. Those of ordinary skill in this field can obtain other embodiments without innovative efforts, and these embodiments should be considered still covered the scope of the present invention.

In addition, terms in the following description such as "up," "down," "front," "back," "left," "right," "inner," "outer," "side," are based on the accompanied drawings. These terms are used so that the present invention may be better and more clearly explained. They are not intended to limit the referred elements to have specific orientation, or to be operated according to specific directions. Therefore, they should not be interpreted as limitations to the present invention.

It should be noted that, unless explicitly specified otherwise, terms like "dispose," "join," "connect," etc. should be interpreted broadly. For example, "connect" could mean a fixed connection, a detachable connection, or an integral connection. It may also mean a mechanical connection or an electrical connection. It may be a direct connection, a connection through an intermediate medium, or an internal connection between two elements. For persons skilled in the related art, they should be able to understand the specific meanings of these terms within the context of the present invention.

In addition, unless otherwise specified, the terms "multiple" and "a number of" refer to two or more entities. the term "process" may refer to an independent process or a subset of another process as long as the subset may fulfill the intended function. Furthermore, a numerical range using two values separated by "~" specifies that the range is inclusive of the two values as the range's minimum and maximum. In the drawings, similar or identical elements are denoted by identical reference numerals.

The present invention teaches a GOA (Gate driver On Array) circuit. By having a first clock signal and a second clock signal in the GOA circuit that respectively control a first pull-down holding circuit and a second pull down holding circuit, fewer signal lines are required by the pull-down holding circuits while guaranteeing the overall reliability of the GOA circuit. In the following, detailed description to an embodiment of the GOA circuit and a LCD device having the GOA circuit is provided, together with the accompanied FIGS. 1 to 3.

FIG. 1 is a block diagram showing a GOA circuit according to an embodiment of the present invention. As illustrated, a GOA circuit 100 includes multiple cascaded GOA units. An (n)th GOA unit charges an (n)th scan line of the active area of a LCD panel. The (n)th GOA unit at least includes a pull-up control circuit 10, a pull-up circuit 20, a pull-down circuit 30, a reset circuit 40, a first pull-down holding circuit 50, a leakage prevention circuit 60, a second pull down holding circuit 70, and a stabilizer circuit 80, where n is a positive integer.

The pull-up control circuit 10 receives an activation signal CT, and outputs a pull-up control signal Q(n) according to the activation signal CT.

Specifically, when n is greater than or equal to 1, and n is less than or equal to 4, the activation signal CT is an initialization signal STV. In other words, when 4, the pull-up control circuit 10 outputs the pull-up control signal Q(n) according to the initialization signal STV. When n is greater than 4, the activation signal CT includes an (n−4)th cascade signal ST(n−4) and an (n−4)th scan signal G(n−4) output from the (n−4)th GOA unit. In other words, when n>4, the pull-up control circuit 10 outputs the pull-up control signal Q(n) according to the (n−4)th cascade signal ST(n−4) and the (n−4)th scan signal G(n−4).

Therefore, when 1≤n≤4, the 1st GOA unit, the 2nd GOA unit, the 3rd GOA unit, and the 4 th GOA unit are activated by the initialization signal STV and, when n>4, the (n)th GOA unit is activated by the (n−4)th cascade signal ST(n−4) and the (n−4)th scan signal G(n−4) output from the (n−4)th GOA unit. As such, the GOA circuit 100 is turned on stage by stage, and the scan lines are driven and charged line by line.

The pull-up circuit 20 is electrically connected to the pull-up control circuit 10, receives the pull-up control signal Q(n) and a first clock signal CK, and outputs an (n)th cascade signal ST(n) and an (n)th scan signal G(n) according to the pull-up control signal Q(n) and the first clock signal CK.

The pull-down circuit 30 is electrically connected to the pull-up control circuit 10 and the pull-up circuit 20, receives an (n+4)th cascade signal ST(n+4) from an (n+4)th GOA unit, a first DC low-voltage signal VSSG1, and a second DC low-voltage signal VSSQ2, and pulls down the pull-up control signal Q(n) and the (n)th scan signal G(n) according to the (n+4)th cascade signal ST(n+4), the first DC low-voltage signal VSSG1, and the second DC low-voltage signal VSSQ2, so that the pull-up control signal Q(n) and the (n)th scan signal G(n) are at a turn-off state (i.e., at a low level).

The reset circuit 40 is electrically connected to the pull-up control circuit 10 and the pull-up circuit 20, receives the initialization signal STV and the first DC low-voltage signal VSSG1, and resets the pull-up control signal Q(n) according to the initialization signal STV and the first DC low-voltage signal VSSG1.

The first pull-down holding circuit 50 is electrically connected to the pull-up control circuit 10, the pull-up circuit 20, the pull-down circuit 30, and the reset circuit 40. The first pull-down holding circuit 50 receives the first clock signal OK, the (n)th cascade signal ST(n), the first DC low-voltage signal VSSG1, and the second DC low-voltage signal VSSQ2, and keeps the pull-up control signal Q(n) and the (n)th scan signal G(n) at the turn-off state according to the first clock signal CK, the first DC low-voltage signal VSSG1, and the second DC low-voltage signal VSSQ2, so as to enhance the first pull-down holding circuit 50's pull-down holding capability according to the (n)th cascade signal ST(n).

The leakage prevention circuit 60 is electrically connected to the first pull-down holding circuit 50, receives the (n−4)th cascade signal ST(n−4) and the second DC low-voltage signal VSSQ2, and prevents the pull-up control signal Q(n) from leaking through the first pull-down holding circuit 50 according to the (n−4)th cascade signal ST(n−−4) and the second DC low-voltage signal VSSQ2.

The second pull down holding circuit 70 is electrically connected to the pull-up control circuit 10, the pull-up circuit 20, the pull-down circuit 30, the reset circuit 40, the first pull-down holding circuit 50, and the leakage prevention circuit 60. The second pull down holding circuit 70 receives a second clock signal XCK, the (n−4)th cascade signal ST(n−4), and the first DC low-voltage signal VSSG1, and keeps the pull-up control signal Q(n) and the (n)th scan signal G(n) at the turn-off state according to the second clock signal XCK and the first DC low-voltage signal VSSG1.

The stabilizer circuit 80 is electrically connected to the pull-up circuit 20, the first pull-down holding circuit 50, and the leakage prevention circuit 60. The stabilizer circuit 80 receives the (n+4)th cascade signal ST(n+4) and the second DC low-voltage signal VSSQ2, and keeps the (n)th cascade signal ST(n) at the second DC low-voltage signal VSSQ2 according to the (n+4)th cascade signal ST(n+4) and the second DC low-voltage signal VSSQ2.

It should be noted that, in the present embodiment, the first clock signal CK and the second clock signal XCK are inverted to each other. When the first clock signal CK is at a high level, the second clock signal XCK is at a low level; when the first clock signal CK is at the low level, the second clock signal XCK is at the high level. The first pull-down holding circuit 50 and the second pull down holding circuit 70 alternately keep the pull-up control signal Q(n) and the (n)th scan signal G(n) at the turn-off state (i.e., at the low level).

Figure 2:
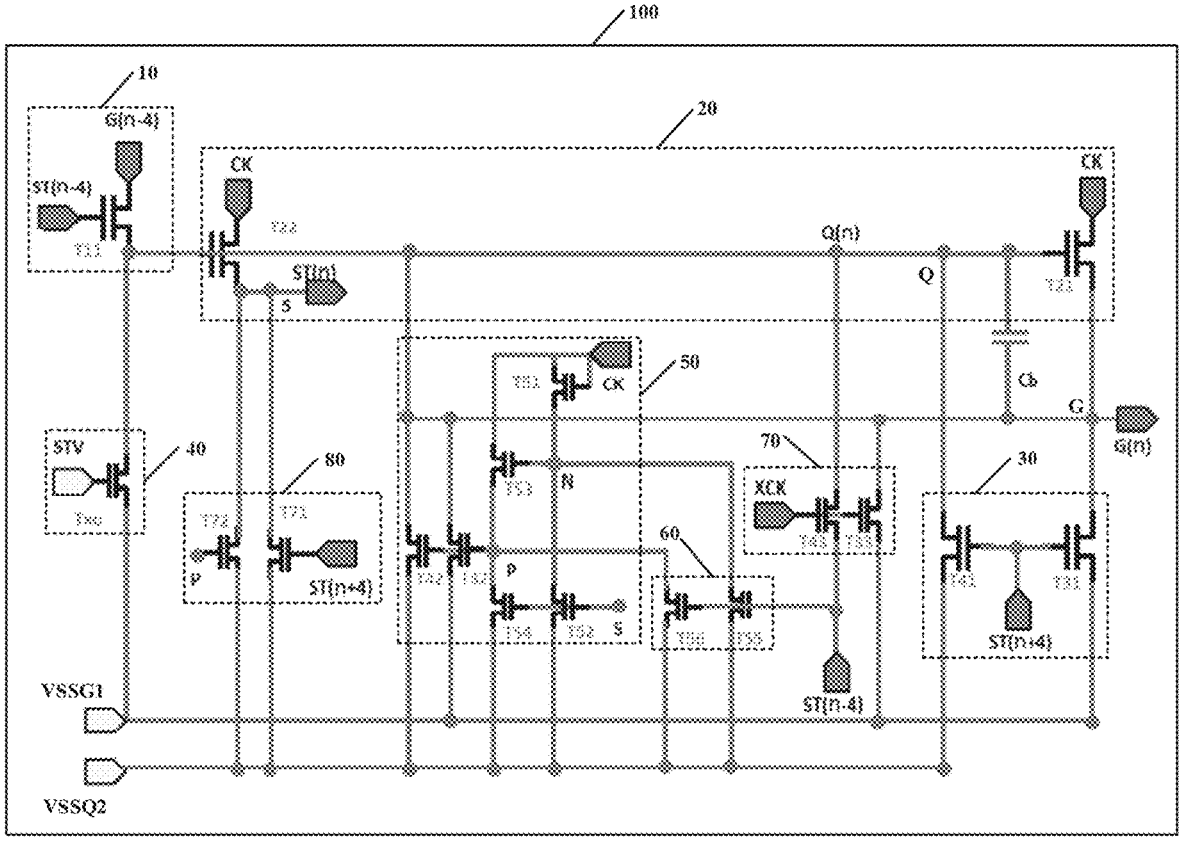
FIG. 2 is a circuit diagram showing a GOA circuit according to an embodiment of the present invention.

FIG. 2 is a circuit diagram showing a GOA circuit according to an embodiment of the present invention. As illustrated, the GOA circuit 100 includes, but is not limited to, the pull-up control circuit 10, pull-up circuit 20, pull-down circuit 30, reset circuit 40, first pull-down holding circuit 50, leakage prevention circuit 60, second pull down holding circuit 70, and stabilizer circuit 80, as shown in FIG. 1.

The pull-up control circuit 10 includes a first TFT T11

For $1 \leq n \leq 4$, the first TFT T11 receives an initialization signal STV from its control terminal and a first terminal, and has a second terminal connected to a pull-up control signal junction Q and outputs a pull-up control signal Q(n) according to the initialization signal STV.

For n>4, the first TFT T11 receives an (n−4)th cascade signal ST(n−4) from the control terminal and an (n−4)th scan signal G(n−4) from the first terminal, and has the second terminal connected to the pull-up control signal junction Q and outputs the pull-up control signal Q(n) according to the (n−4)th cascade signal ST(n−4) and the (n−4)th scan signal G(n−4).

It should be noted that FIGS. 1 and 2 only illustrate signal input to the pull-up control circuit 10 for n>4. For example, only the (n−4)th cascade signal ST(n−4) and the (n−4)th scan signal G(n−4) are shown in FIGS. 1 and 2.

The pull-up circuit 20 includes a second TFT T22 and a third TFT T21. The second TFT T22 outputs an (n)th cascade signal ST(n) according to the pull-up control signal Q(n) and a first clock signal CK. Specifically, the second TFT T22 has a control terminal electrically connected to the pull-up control signal junction Q for receiving the pull-up control signal Q(n), receives the first clock signal CK from a first terminal, and has a second terminal electrically connected to a first signal junction S for outputting the (n)th cascade signal ST(n). The third TFT T21 outputs an (n)th scan signal G(n) according to the pull-up control signal Q(n) and the first clock signal CK. Specifically, the third TFT T21 has a control terminal electrically connected to the pull-up control signal junction Q for receiving the pull-up control signal Q(n), receives the first clock signal CK from a first terminal, and has a second terminal electrically connected to a scan line G for outputting the (n)th scan signal G(n).

The pull-down circuit 30 includes a fourth TFT T31 and a fifth TFT T41. The fourth TFT T31 has a control terminal electrically connected to a control terminal of the fifth TFT T41 for receiving an (n+4)th cascade signal ST(n+4). The fourth TFT T31 has a first terminal electrically connected to the scan line G, and receives a first DC low-voltage signal VSSG1 from a second terminal. The fourth TFT T31 pulls down the (n)th scan signal G(n) according to the (n+4)th cascade signal ST(n+4) and the first DC low-voltage signal VSSG1 so that the (n)th scan signal G(n)is at a turn-off state (i.e., at a low level). The fifth TFT T41 has a first terminal electrically connected to the pull-up control signal junction Q, and receives a second DC low-voltage signal VSSQ2 from a second terminal. The fifth TFT T41 pulls down the pull-up control signal Q(n) according to the (n+4)th cascade signal ST(n+4) and the second DC low-voltage signal VSSQ2 so that the pull-up control signal Q(n) is at the turn-off state (i.e., at the low level).

The first DC low-voltage signal VSSG1 is the DC low-voltage signal required by the LCD panel. It should be noted that the second DC low-voltage signal VSSQ2 is lower than the first DC low-voltage signal VSSG1. By the second DC low-voltage signal VSSQ2, the voltage level at the pull-up control signal junction Q may be pulled down even lower, thereby preventing leakage from the pull-up control signal junction Q and enhancing the GOA circuit 100's overall reliability.

It should be noted that the (n+4)th cascade signal ST(n+4) at the control terminals of the fourth TFT T31 and the fifth TFT T41 prevents the pull-down circuit 30 from influence by anomaly in the scan line G resulted some anomaly in the active area of the LCD panel, thereby lowering the risk of anomaly in the GOA circuit 100. In addition, when the fourth TFT T31 and the fifth TFT T41 receive the (n+4)th cascade signal ST(n+4) from their control terminals, the GOA circuit 100 behaves in a manner of symmetric pull down and pull up, so that the GOA circuit 100 does not produce a large current even when anomaly occurs.

The reset circuit 40 includes a sixth TFT Txo which receives the initialization signal STV from a control terminal, has a first terminal electrically connected to the pull-up control signal junction Q, and receives the first DC low-voltage signal VSSG1 from a second terminal. The sixth TFT Txo, after the GOA circuit 100 operates a cycle, resets the pull-up control signal junction Q's level (i.e., resets the pull-up control signal Q(n)) according to the initialization signal STV and the first DC low-voltage signal VSSG1. As such, the pull-up control signal junction Q is better and more quickly discharged after the GOA circuit 100 operates a cycle, preventing the occurrence of a large current and anomaly in the LCD panel due to the untimely discharge of the pull-up control signal junction Q resulted from repeated shutdowns of the LCD panel.

The first pull-down holding circuit 50 includes a seventh TFT T51, an eighth TFT T52, a ninth TFT T53, a tenth TFT T54, an eleventh TFT T42, and a twelfth TFT T32. The seventh TFT T51 receives the first clock signal CK from a control terminal and a first terminal, and has a second terminal electrically connected to a second signal junction N. The eighth TFT T52 has a control terminal electrically connected to the first signal junction S for receiving the (n)th cascade signal ST(n), has a first terminal electrically connected to the second signal junction N, and receives the second DC low-voltage signal VSSQ2 from a second terminal. The ninth TFT T53 has a control terminal electrically connected to the second signal junction N, receives the first clock signal CK from a first terminal, and has a second terminal electrically connected to a third signal junction P. The tenth TFT T54 has a control terminal electrically connected to the first signal junction S for receiving the (n)th cascade signal ST(n), has a first terminal electrically connected to the third signal junction P and receives the second DC low-voltage signal VSSQ2 from a second terminal. The eleventh TFT T42 has a control terminal electrically connected to the third signal junction P, has a first terminal electrically connected to the pull-up control signal junction Q and the scan line G, and receives the second DC low-voltage signal VSSQ2 from a second terminal. The eleventh TFT T42 keeps the pull-up control signal Q(n) and the (n)th scan signal G(n) at the turn-off state according to the first clock signal CK and the second DC low-voltage signal VSSQ2. The twelfth TFT T32 has a control terminal electrically connected to the third signal junction P, has a first terminal electrically connected to the pull-up control signal junction Q and the scan line G, and receives the first DC low-voltage signal VSSG1 from a second terminal. The twelfth TFT T32 keeps the pull-up control signal Q(n) and the (n)th scan signal G(n) at the turn-off state according to the first clock signal CK and the first DC low-voltage signal VSSG1.

It should be noted that the (n)th cascade signal ST(n) at the control terminals of the eighth TFT T52 and the tenth TFT T54 reduces the stress effect and enhances pull-down holding capability of the eleventh TFT T42 and the twelfth TFT T32 in respectively keeping the pull-up control signal Q(n) and the (n)th scan signal G(n) at the turn-off state, The stress effect refers to the decay of TFT's physical characteristics after an extended period of operation.

Figure 3:
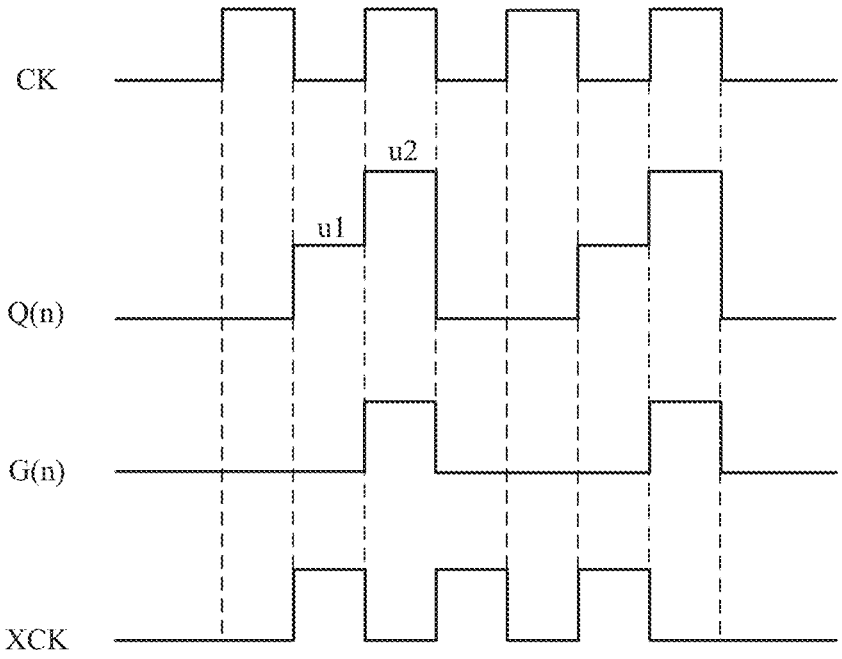
FIG. 3 is a waveform diagram showing key junction signals in the GOA circuit of FIGS. 1 and 2.

The leakage prevention circuit 60 includes a thirteenth TFT T56 and a fourteenth TFT T55. The thirteenth TFT T56 receives the (n−4)th cascade signal ST(n−4) from a control terminal, has a first terminal electrically connected to the third signal junction P, and receives the second DC low-voltage signal VSSQ2 from a second terminal. The thirteenth TFT T56 pulls the eleventh TFT T42 down to the second DC low-voltage signal VSSQ2 before a first rising stage u1 in the pull-up control signal Q(n) (as shown in FIG. 3), so as to prevent the eleventh TFT T42 from leakage. The fourteenth TFT T55 receives the (n−4)th cascade signal ST(n−4) from a control terminal, has a first terminal electrically connected to the second signal junction N, and receives the second DC low-voltage signal VSSQ2 from a second terminal. The fourteenth TFT T55 prevents the ninth TFT T53 from leakage, which in turn prevents the eleventh TFT T42 from leakage.

It should be noted that the leakage prevention to the eleventh TFT T42 may prevent leakage from the pull-up control signal junction Q, so that the pull-up control signal Q(n) may be charged to a higher level in the first rising stage u1, thereby facilitating the pull-up control signal Q(n)'s charge in a second rising stage u2 (as shown in FIG. 3) and enhancing the GOA circuit 100's overall reliability.

The second pull down holding circuit 70 includes a fifteenth TFT T43 and a sixteenth TFT T33, The fifteenth TFT T43 receives the second clock signal XCK from a control terminal, has a first terminal electrically connected to the pull-up control signal junction Q, and receives the (n−4)th cascade signal ST(n−4) from a second terminal. The fifteenth TFT T43 keeps the pull-up control signal Q(n) at the turn-off state according to the second clock signal XCK and the (n−4)th cascade signal ST(n−4). The sixteenth TFT T33 receives the second clock signal XCK from a control terminal, has a first terminal electrically connected to the scan line G, and receives the first DC low-voltage signal VSSG1 from a second terminal. The sixteenth TFT T33 keeps the (n)th scan signal G(n) at the turn-off state according to the second clock signal XCK and the first DC low-voltage signal VSSG1.

It should be noted that the fifteenth TFT T43 receives the (n−4)th cascade signal ST(n−4) from its second terminal so that the pull-up control signal Q(n) is simultaneously charged by the first TFT T11 and the fifteenth TFT T43 during the first rising stage u1 so as to increase the pull-up control signal Q(n)'s voltage during the first rising stage u1, thereby enhancing the GOA circuit 100's overall reliability.

The stabilizer circuit 80 includes a seventeenth TFT T72 and an eighteenth TFT T71. The seventeenth TFT T72 has a control terminal electrically connected to the third signal junction P, has a first terminal electrically connected to the first signal junction S, and receives the second DC low-voltage signal VSSQ2 from a second terminal, The seventeenth TFT T72 stabilizes the (n)th cascade signal ST(n) at the second DC low-voltage signal VSSQ2 according to the first clock signal CK and the second DC low-voltage signal VSSQ2 during the pull-down and pull-down holding processes of the pull-up control signal Q(n). The eighteenth TFT T71 receives the (n+4)th cascade signal ST(n+4) from a control terminal, has a first terminal electrically connected to the first signal junction S, and receives the second DC low-voltage signal VSSQ2 from a second terminal. The eighteenth TFT T71 stabilizes the (n)th cascade signal ST(n) at the second DC low-voltage signal VSSQ2 according to the (n+4)th cascade signal ST(n+4) and the second DC low-voltage signal VSSQ2 during the pull-down and pull-down holding processes of the pull-up control signal Q(n).

It should be noted that, in the present embodiment, the pull-up control signal junction Q is electrically connected to the scan line G through a capacitor Cb. The capacitor Cb is a Boast capacitor.

FIG. 3 is a waveform diagram showing key junction signals in the GOA circuit of FIGS. 1 and 2. The key junction signals includes, but are not limited to, the first clock signal CK, the pull-up control signal Q(n), the (n)th scan signal G(n), and the second clock signal XCK.

As illustrated, the first clock signal CK and the second clock signal XCK are inverted to each other. The pull-up control signal Q(n) includes two rising stages: the first rising stage u1 and the second rising stage u2. In the second rising stage u2, the pull-up circuit 20 outputs the (n)th scan signal G(n).

The present invention also teaches a LCD device including the GOA circuit 100 shown in FIGS. 1 and 2. The LCD device includes, but are not limited to, a mobile phone having a LCD panel (e.g., an Android phone, iOS phone, etc.), a tablet computer, a Mobile Internet Device (MID), a Personal Digital Assistant (PDA), a notebook computer, a TV, an electronic paper, a digital photo frame, etc.

Compared to the prior art that uses the first low-frequency signal LC1 and the second low-frequency signal LC2 to make the first pull-down holding circuit and the second pull-down holding circuit to function alternately, the present embodiment uses the first clock signal CK and the second clock signal XCK in the GOA circuit 100 to respectively control the first pull-down holding circuit 50 and the second pull-down holding circuit 70 so that a less number of signal lines for the pull-down holding circuits is achieved while the alternation of the two pull-down holding circuits remains effective, thereby guaranteeing the GOA circuit 100's overall reliability. In addition, the second DC low-voltage signal VSSQ2, the reset circuit 40, the leakage prevention circuit 60, and the stabilizer circuit 80 in the present embodiment further enhance the GOA circuit 100's overall reliability.

In the present specification, phrases such as "an embodiment," "some embodiments," "an example," "some examples," etc. means that their specified characteristic, structure, material, or feature described may be independently applied or jointly combined in at least one embodiment of the present invention. These phrases also are not necessarily referring to a same embodiment. Their characteristics, structures, materials, or features may be appropriately integrated in one or more embodiments.

Above are embodiments of the present invention, which does not limit the scope of the present invention. Any equivalent amendments within the spirit and principles of the embodiment described above should be covered by the protected scope of the invention.

What is claimed is:

1. A Gate driver On Array (GOA) circuit, comprising a plurality of cascaded GOA units, wherein an (n)th GOA unit charges an (n)th scan line of the active area of a panel; the (n)th GOA unit comprises a pull-up control circuit, a pull-up circuit, a pull-down circuit, a first pull-down holding circuit, and a second pull down holding circuit (n is a positive integer);

the pull-up control circuit receives an activation signal CT, and outputs a pull-up control signal Q(n) according to the activation signal CT;

the pull-up circuit is electrically connected to the pull-up control circuit, receives the pull-up control signal Q(n) and a first clock signal CK, and outputs an (n)th cascade signal ST(n) and an (n)th scan signal G(n) according to the pull-up control signal Q(n) and the first clock signal CK;

the pull-down circuit is electrically connected to the pull-up control circuit and the pull-up circuit, receives an (n+4)th cascade signal ST(n+4) from an (n+4)th GOA unit, a first DC low-voltage signal VSSG1, and a second DC low-voltage signal VSSQ2, and pulls down the pull-up control signal Q(n) and the (n)th scan signal G(n) according to the (n+4)th cascade signal ST(n+4), the first DC low-voltage signal VSSG1, and the second DC low-voltage signal VSSQ2, so that the pull-up control signal Q(n) and the (n)th scan signal G(n) are at a turn-off state;

the first pull-down holding circuit is electrically connected to the pull-up control circuit, the pull-up circuit, and the pull-down circuit; the first pull-down holding circuit receives the first clock signal CK, the (n)th cascade signal ST(n), the first DC low-voltage signal VSSG1, and the second DC low-voltage signal VSSQ2, and keeps the pull-up control signal Q(n) and the (n)th scan signal G(n) at the turn-off state according to the first clock signal CK, the first DC low-voltage signal VSSG1, and the second DC low-voltage signal VSSQ2;

the second pull down holding circuit is electrically connected to the pull-up control circuit, the pull-up circuit, the pull-down circuit, and the first pull-down holding circuit; and the second pull down holding circuit receives a second clock signal XCK, the (n−4)th cascade signal ST(n−4), and the first DC low-voltage signal VSSG1, and keeps the pull-up control signal Q(n) and the (n)th scan signal G(n) at the turn-off state according to the second clock signal XCK and the first DC low-voltage signal VSSG1.

2. The GOA circuit according to claim 1, wherein, when n is greater than or equal to 1, and n is less than or equal to 4, the activation signal CT is an initialization signal STV; the pull-up control circuit outputs the pull-up control signal Q(n) according to the initialization signal STV; when n is greater than 4, the activation signal CT comprises an (n−4)th cascade signal ST(n−4) and an (n−4)th scan signal G(n−4) output from an (n−4)th GOA unit; the pull-up control circuit outputs the pull-up control signal Q(n) according to the (n−−4)th cascade signal ST(n−4) and the (n−4)th scan signal G(n−4).

3. The GOA circuit according to claim 1, wherein the first pull-down holding circuit and the second pull down holding circuit alternately keep the pull-up control signal Q(n) and the (n)th scan signal G(n) at the turn-off state.

4. The GOA circuit according to claim 3, wherein the first clock signal CK and the second clock signal XCK are inverted to each other.

5. The GOA circuit according to claim 1, wherein the (n)th GOA unit further comprises a reset circuit, a leakage prevention circuit, and a stabilizer circuit;

the reset circuit is electrically connected to the pull-up control circuit and the pull-up circuit, receives the initialization signal STV and the first DC low-voltage signal VSSG1, and resets the pull-up control signal Q(n) according to the initialization signal STV and the first DC low-voltage signal VSSG1;

the leakage prevention circuit is electrically connected to the first pull-down holding circuit, receives the (n−4)th cascade signal ST(n−4) and the second DC low-voltage signal VSSQ2, and prevents the pull-up control signal Q(n) from leaking through the first pull-down holding circuit according to the (n−4)th cascade signal ST(n−4) and the second DC low-voltage signal VSSQ2;

the stabilizer circuit is electrically connected to the pull-up circuit, the first pull-down holding circuit, and the leakage prevention circuit; and the stabilizer circuit receives the (n+4)th cascade signal ST(n+4) and the second DC low-voltage signal VSSQ2, and keeps the (n)th cascade signal ST(n) at the second DC low-voltage signal VSSQ2 according to the (n+4)th cascade signal ST(n+4) and the second DC low-voltage signal VSSQ2.

6. The GOA circuit according to claim 5, wherein the pull-up control circuit comprises a first TFT (T11); when n is greater than or equal to 1, and n is less than or equal to 4, the first TFT (T11) receives the initialization signal STV from a control terminal and a first terminal, has a second terminal connected to a pull-up control signal junction Q, and outputs the pull-up control signal Q(n) according to the initialization signal STV; when n is greater than 4, the first TFT (T11) receives the (n−4)th cascade signal ST(n−4) from a control terminal, receives the (n−4)th scan signal G(n−4) from a first terminal, has a second terminal connected to the pull-up control signal junction Q, and outputs the pull-up control signal Q(n) according to the (n−4)th cascade signal ST(n−4) and the (n−4)th scan signal G(n−4);

the pull-up circuit comprises a second TFT (T22) and a third TFT (T21); the second TFT (T22) has a control terminal electrically connected to the pull-up control signal junction Q for receiving the pull-up control signal Q(n), receives the first clock signal CK from a first terminal, has a second terminal electrically connected to a first signal junction S, and outputs the (n)th cascade signal ST(n) according to the pull-up control signal Q(n) and the first clock signal CK; the third TFT (T21) has a control terminal electrically connected to the pull-up control signal junction Q for receiving the pull-up control signal Q(n), receives the first clock signal CK from a first terminal, has a second terminal electrically connected to a scan line G, and outputs the (n)th scan signal G(n) according to the pull-up control signal Q(n) and the first clock signal CK;

the pull-down circuit 30 comprises a fourth TFT (T31) and a fifth TFT (T41); the fourth TFT (T31) has a control terminal electrically connected to a control terminal of the fifth TFT (T41) for receiving an (n+4)th cascade signal ST(n+4), has a first terminal electrically connected to the scan line G, receives a first DC low-voltage signal VSSG1 from a second terminal, and pulls down the (n)th scan signal G(n) according to the (n+4)th cascade signal ST(n+4) and the first DC low-voltage signal VSSG1 so that the (n)th scan signal G(n) is at the turn-off state; the fifth TFT (T41) has a first terminal electrically connected to the pull-up control signal junction Q, receives a second DC low-voltage signal VSSQ2 from a second terminal, and pulls down the pull-up control signal Q(n) according to the (n+4)th cascade signal ST(n+4) and the second DC low-voltage signal VSSQ2 so that the pull-up control signal Q(n) is at the turn-off state.

7. The GOA circuit according to claim 6, wherein the reset circuit comprises a sixth TFT (Txo) which receives the initialization signal STV from a control terminal, has a first terminal electrically connected to the pull-up control signal junction Q, and receives the first DC low-voltage signal VSSG1 from a second terminal; the sixth TFT (Txo), after the GOA circuit operates a cycle, resets the pull-up control signal junction Q's level according to the initialization signal STV and the first DC low-voltage signal VSSG1;

the first pull-down holding circuit comprises a seventh TFT (T51), an eighth TFT (T52), a ninth TFT (T53), a tenth TFT (T54), an eleventh TFT (T42), and a twelfth TFT (T32); the seventh TFT (T51) receives the first clock signal CK from a control terminal and a first terminal, and has a second terminal electrically connected to a second signal junction N; the eighth TFT (T52) has a control terminal electrically connected to the first signal junction S for receiving the (n)th cascade signal ST(n), has a first terminal electrically connected to the second signal junction N, and receives the second DC low-voltage signal VSSQ2 from a second terminal; the ninth TFT (T53) has a control terminal electrically connected to the second signal junction N, receives the first clock signal CK from a first terminal, and has a second terminal electrically connected to a third signal junction P; the tenth TFT (T54) has a control terminal electrically connected to the first signal junction S for receiving the (n)th cascade signal ST(n), has a first terminal electrically connected to the third signal junction P, and receives the second DC low-voltage signal VSSQ2 from a second terminal; the eleventh TFT (T42) has a control terminal electrically connected to the third signal junction P, has a first terminal electrically connected to the pull-up control signal junction Q and the scan line G, receives the second DC low-voltage signal VSSQ2 from a second terminal, and keeps the pull-up control signal Q(n) and the (n)th scan signal G(n) at the turn-off state according to the first clock signal CK and the second DC low-voltage signal VSSQ2; the twelfth TFT (T32) has a control terminal electrically connected to the third signal junction P, has a first terminal electrically connected to the pull-up control signal junction Q and the scan line G, receives the first DC low-voltage signal VSSG1 from a second terminal, and keeps the pull-up control signal Q(n) and the (n)th scan signal G(n) at the turn-off state according to the first clock signal CK and the first DC low-voltage signal VSSG1;

the leakage prevention circuit comprises a thirteenth TFT (T56) and a fourteenth TFT (T55); the thirteenth TFT (T56) receives the (n−4)th cascade signal ST(n−4) from a control terminal, has a first terminal electrically connected to the third signal junction P, and receives the second DC low-voltage signal VSSQ2 from a second terminal; the fourteenth TFT (T55) receives the (n−4)th cascade signal ST(n−4) from a control terminal, has a first terminal electrically connected to the second signal junction N, and receives the second DC low-voltage signal VSSQ2 from a second terminal;

the second pull down holding circuit comprises a fifteenth TFT (T43) and a sixteenth TFT (T33); the fifteenth TFT T43 receives the second clock signal XCK from a control terminal, has a first terminal electrically connected to the pull-up control signal junction Q, and receives the (n−4)th cascade signal ST(n−4) from a second terminal, and keeps the pull-up control signal Q(n) at the turn-off state according to the second clock signal XCK and the (n−4)th cascade signal ST(n−4); the sixteenth TFT (T33) receives the second clock signal XCK from a control terminal, has a first terminal electrically connected to the scan line G, receives the first DC low-voltage signal VSSG1 from a second terminal, and keeps the (n)th scan signal G(n) at the turn-off state according to the second clock signal XCK and the first DC low-voltage signal VSSG1;

the stabilizer circuit comprises a seventeenth TFT (T72) and an eighteenth TFT (T71); the seventeenth TFT (T72) has a control terminal electrically connected to the third signal junction F, has a first terminal electrically connected to the first signal junction S, receives the second DC low-voltage signal VSSQ2 from a second terminal, and stabilizes the (n)th cascade signal ST(n) at the second DC low-voltage signal VSSQ2 according to the first clock signal CK and the second DC low-voltage signal VSSQ2; and the eighteenth TFT (T71) receives the (n+4)th cascade signal ST(n+4) from a control terminal, has a first terminal electrically connected to the first signal junction S, receives the second DC low-voltage signal VSSQ2 from a second terminal, and stabilizes the (n)th cascade signal ST(n) at the second DC low-voltage signal VSSQ2 according to the (n+4)th cascade signal ST(n+4) and the second DC low-voltage signal VSSQ2.

8. The GOA circuit according to claim 7, wherein the first DC low-voltage signal VSSG1 is a DC low-voltage signal required by the LCD panel; and the second DC low-voltage signal VSSQ2 is less than the first DC low-voltage signal VSSG1.

9. The GOA circuit according to claim 7, wherein the pull-up control signal junction Q is electrically connected to the scan line G through a capacitor (Cb); and the capacitor (Cb) is a Boast capacitor.

10. A liquid crystal display (LCD) device, comprising a GOA circuit for a LCD panel, wherein the GOA circuit comprises a plurality of cascaded GOA units; an (n)th GOA unit charges an (n)th scan line of the active area of the LCD panel; the (n)th GOA unit comprises a pull-up control circuit, a pull-up circuit, a pull-down circuit, a first pull-down holding circuit, and a second pull down holding circuit (n is a positive integer);

the pull-up control circuit receives an activation signal CT, and outputs a pull-up control signal Q(n) according to the activation signal CT;

the pull-up circuit is electrically connected to the pull-up control circuit, receives the pull-up control signal Q(n) and a first clock signal CK, and outputs an (n)th cascade signal ST(n) and an (n)th scan signal G(n) according to the pull-up control signal Q(n) and the first clock signal CK;

the pull-down circuit is electrically connected to the pull-up control circuit and the pull-up circuit, receives an (n+4)th cascade signal ST(n+4) from an (n+4)th GOA unit, a first DC low-voltage signal VSSG1, and a second DC low-voltage signal VSSQ2, and pulls down the pull-up control signal Q(n) and the (n)th scan signal G(n) according to the (n+4)th cascade signal ST(n+4), the first DC low-voltage signal VSSG1, and the second DC low-voltage signal VSSQ2, so that the pull-up control signal Q(n) and the (n)th scan signal G(n) are at a turn-off state;

the first pull-down holding circuit is electrically connected to the pull-up control circuit, the pull-up circuit, and the pull-down circuit; the first pull-down holding circuit receives the first clock signal CK, the (n)th cascade signal ST(n), the first DC low-voltage signal VSSG1, and the second DC low-voltage signal VSSQ2, and keeps the pull-up control signal Q(n) and the (n)th scan signal G(n) at the turn-off state according to the first clock signal CK, the first DC low-voltage signal VSSG1, and the second DC low-voltage signal VSSQ2;

the second pull down holding circuit is electrically connected to the pull-up control circuit, the pull-up circuit, the pull-down circuit, and the first pull-down holding circuit; and the second pull down holding circuit receives a second clock signal XCK, the (n−4)th cascade signal ST(n−4), and the first DC low-voltage signal VSSG1, and keeps the pull-up control signal Q(n) and the (n)th scan signal G(n) at the turn-off state according to the second clock signal XCK and the first DC low-voltage signal VSSG1.

11. The LCD device according to claim 10, wherein, when n is greater than or equal to 1, and n is less than or equal to 4, the activation signal CT is an initialization signal STV; the pull-up control circuit outputs the pull-up control signal Q(n) according to the initialization signal STU; when n is greater than 4, the activation signal CT comprises an (n−4)th cascade signal ST(n−4) and an (n−4)th scan signal G(n−4) output from an (n−4)th GOA unit; the pull-up control circuit outputs the pull-up control signal Q(n) according to the (n−4)th cascade signal ST(n−4) and the (n−4)th scan signal G(n−4).

12. The LCD device according to claim 10, wherein the first pull-down holding circuit and the second pull down holding circuit alternately keep the pull-up control signal Q(n) and the (n)th scan signal G(n) at the turn-off state.

13. The LCD device according to claim 12, wherein the first clock signal CK and the second clock signal XCK are inverted to each other.

14. The LCD device according to claim 10, wherein the (n)th GOA unit further comprises a reset circuit, a leakage prevention circuit, and a stabilizer circuit;

the reset circuit is electrically connected to the pull-up control circuit and the pull-up circuit, receives the initialization signal STV and the first DC low-voltage signal VSSG1, and resets the pull-up control signal Q(n) according to the initialization signal STV and the first DC low-voltage signal VSSG1;

the leakage prevention circuit is electrically connected to the first pull-down holding circuit, receives the (n−4)th cascade signal ST(n−4) and the second DC low-voltage signal VSSQ2, and prevents the pull-up control signal Q(n) from leaking through the first pull-down holding circuit according to the (n−4)th cascade signal ST(n−4) and the second DC low-voltage signal VSSQ2;

the stabilizer circuit is electrically connected to the pull-up circuit, the first pull-down holding circuit, and the leakage prevention circuit; and the stabilizer circuit receives the (n+4)th cascade signal ST(n+4) and the second DC low-voltage signal VSSQ2, and keeps the (n)th cascade signal ST(n) at the second DC low-voltage signal VSSQ2 according to the (n+4)th cascade signal ST(n+4) and the second DC low-voltage signal VSSQ2.

15. The LCD device according to claim 14, wherein the pull-up control circuit comprises a first TFT (T11); when n is greater than or equal to 1, and n is less than or equal to 4, the first TFT (T11) receives the initialization signal STV from a control terminal and a first terminal, has a second terminal connected to a pull-up control signal junction Q, and outputs the pull-up control signal Q(n) according to the initialization signal STV; when n is greater than 4, the first TFT (T11) receives the (n−4)th cascade signal ST(n−4) from a control terminal, receives the (n−4)th scan signal G(n−4) from a first terminal, has a second terminal connected to the pull-up control signal junction Q, and outputs the pull-up control signal Q(n) according to the (n−4)th cascade signal ST(n−4) and the (n−4)th scan signal G(n−4);

the pull-up circuit comprises a second TFT (T22) and a third TFT (T21); the second TFT (T22) has a control terminal electrically connected to the pull-up control signal junction Q for receiving the pull-up control signal Q(n), receives the first clock signal CK from a first terminal, has a second terminal electrically connected to a first signal junction S, and outputs the (n)th cascade signal ST(n) according to the pull-up control signal Q(n) and the first clock signal CK; the third TFT (T21) has a control terminal electrically connected to the pull-up control signal junction Q for receiving the pull-up control signal Q(n), receives the first clock signal CK from a first terminal, has a second terminal electrically connected to a scan line G, and outputs the (n)th scan signal G(n) according to the pull-up control signal Q(n) and the first clock signal CK;

the pull-down circuit 30 comprises a fourth TFT (T31) and a fifth TFT (T41); the fourth TFT (T31) has a control terminal electrically connected to a control terminal of the fifth TFT (T41) for receiving an (n+4)th cascade signal ST(n+4), has a first terminal electrically connected to the scan line G, receives a first DC low-voltage signal VSSG1 from a second terminal, and pulls down the (n)th scan signal G(n) according to the (n+4)th cascade signal ST(n+4) and the first DC low-voltage signal VSSG1 so that the (n)th scan signal G(n) is at the turn-off state; the fifth TFT (T41) has a first terminal electrically connected to the pull-up control signal junction Q, receives a second DC low-voltage signal VSSQ2 from a second terminal, and pulls down the pull-up control signal Q(n) according to the (n+4)th cascade signal ST(n+4) and the second DC low-voltage signal VSSQ2 so that the pull-up control signal Q(n) is at the turn-off state.

16. The LCD device according to claim 15, wherein the reset circuit comprises a sixth TFT (Txo) which receives the initialization signal STV from a control terminal, has a first terminal electrically connected to the pull-up control signal junction Q, and receives the first DC low-voltage signal VSSG1 from a second terminal; the sixth TFT (Txo), after the GOA circuit operates a cycle, resets the pull-up control signal junction Q's level according to the initialization signal STV and the first DC low-voltage signal VSSG1;

the first pull-down holding circuit comprises a seventh TFT (T51), an eighth TFT (T52), a ninth TFT (T53), a tenth TFT (T54), an eleventh TFT (T42), and a twelfth TFT (T32); the seventh TFT (T51) receives the first clock signal CK from a control terminal and a first terminal, and has a second terminal electrically connected to a second signal junction N; the eighth TFT (T52) has a control terminal electrically connected to the first signal junction S for receiving the (n)th cascade signal ST(n), has a first terminal electrically connected to the second signal junction N, and receives the second DC low-voltage signal VSSQ2 from a second terminal; the ninth TFT (T53) has a control terminal electrically connected to the second signal junction N, receives the first clock signal CK from a first terminal, and has a second terminal electrically connected to a third signal junction P; the tenth TFT (T54) has a control terminal electrically connected to the first signal junction S for receiving the (n)th cascade signal ST(n), has a first terminal electrically connected to the third signal junction P, and receives the second DC low-voltage signal VSSQ2 from a second terminal; the eleventh TFT (T42) has a control terminal electrically connected to the third signal junction P, has a first terminal electrically connected to the pull-up control signal junction Q and the scan line G, receives the second DC low-voltage signal VSSQ2 from a second terminal, and keeps the pull-up control signal Q(n) and the (n)th scan signal G(n) at the turn-off state according to the first clock signal CK and the second DC low-voltage signal VSSQ2; the twelfth TFT (T32) has a control terminal electrically connected to the third signal junction P, has a first terminal electrically connected to the pull-up control signal junction Q and the scan line G, receives the first DC low-voltage signal VSSG1 from a second terminal, and keeps the pull-up control signal Q(n) and the (n)th scan signal G(n) at the turn-off state according to the first clock signal CK and the first DC low-voltage signal VSSG1;

the leakage prevention circuit comprises a thirteenth TFT (T56) and a fourteenth TFT (T55); the thirteenth TFT (T56) receives the (n−4)th cascade signal ST(n−4) from a control terminal, has a first terminal electrically connected to the third signal junction P, and receives the second DC low-voltage signal VSSQ2 from a second terminal; the fourteenth TFT (T55) receives the (n−4)th cascade signal ST(n−4) from a control terminal, has a first terminal electrically connected to the second signal junction N, and receives the second DC low-voltage signal VSSQ2 from a second terminal;

the second pull down holding circuit comprises a fifteenth TFT (T43) and a sixteenth TFT (T33); the fifteenth TFT T43 receives the second clock signal XCK from a control terminal, has a first terminal electrically connected to the pull-up control signal junction Q, and receives the (n−4)th cascade signal ST(n−4) from a second terminal, and keeps the pull-up control signal Q(n) at the turn-off state according to the second clock signal XCK and the (n−4)th cascade signal ST(n−4); the sixteenth TFT (T33) receives the second clock signal XCK from a control terminal, has a first terminal electrically connected to the scan line G, receives the first DC low-voltage signal VSSG1 from a second terminal, and keeps the (n)th scan signal G(n) at the turn-off state according to the second clock signal XCK and the first DC low-voltage signal VSSG1;

the stabilizer circuit comprises a seventeenth TFT (T72) and an eighteenth TFT (T71); the seventeenth TFT (T72) has a control terminal electrically connected to the third signal junction P, has a first terminal electrically connected to the first signal junction S, receives the second DC low-voltage signal VSSQ2 from a second terminal, and stabilizes the (n)th cascade signal ST(n) at the second DC low-voltage signal VSSQ2 according to the first clock signal CK and the second DC low-voltage signal VSSQ2; and the eighteenth TFT (T71) receives the (n+4)th cascade signal ST(n+4) from a control terminal, has a first terminal electrically connected to the first signal junction S, receives the second DC low-voltage signal VSSQ2 from a second terminal, and stabilizes the (n)th cascade signal ST(n) at the second DC low-voltage signal VSSQ2 according to the (n+4)th cascade signal ST(n+4) and the second DC low-voltage signal VSSQ2.

17. The LCD device according to claim 16, wherein the first DC low-voltage signal VSSG1 is a DC low-voltage signal required by the LCD panel; and the second DC low-voltage signal VSSQ2 is less than the first DC low-voltage signal VSSG1.

18. The LCD device according to claim 16, wherein the pull-up control signal junction Q is electrically connected to the scan line G through a capacitor (Cb); and the capacitor (Cb) is a Boast capacitor.

* * * * *